US006176297B1

(12) United States Patent
Mörwald et al.

(10) Patent No.: US 6,176,297 B1
(45) Date of Patent: Jan. 23, 2001

(54) ADJUSTING DEVICE FOR SETTING THE POSITION OF BILLET-SUPPORT ELEMENTS

(75) Inventors: Karl Mörwald, St. Florian; Helmut Fitzel, Ennsdorf; Kurt Engel; Horst Fürhofer, both of St. Florian; Rudolf Scheidl, Erlauf; Reinhard Brandstetter, Asten, all of (AT)

(73) Assignee: Voest-Alpine Industrieanlagenbau GmbH, Linz (AT)

( * ) Notice: Under 35 U.S.C. 154(b), the term of this patent shall be extended for 0 days.

(21) Appl. No.: 09/180,323

(22) PCT Filed: May 7, 1997

(86) PCT No.: PCT/AT97/00090

§ 371 Date: Nov. 5, 1998

§ 102(e) Date: Nov. 5, 1998

(87) PCT Pub. No.: WO97/41983

PCT Pub. Date: Nov. 13, 1997

(30) Foreign Application Priority Data

Aug. 5, 1996 (AU) ..... 823/96

(51) Int. Cl.[7] ..... B22D 11/128
(52) U.S. Cl. ..... 164/413; 164/442; 164/448
(58) Field of Search ..... 164/413, 442, 164/448, 454

(56) References Cited

U.S. PATENT DOCUMENTS 3,263,284 * 8/1966 Orr et al. ..... 164/413
3,812,900 5/1974 Bollig et al. .
5,348,074 * 9/1994 Streubel ..... 164/413 X
5,709,261 * 1/1998 Streubel ..... 164/419 X

FOREIGN PATENT DOCUMENTS 3835010 4/1990 (DE) .
0023591 2/1981 (EP) .
0025852 4/1981 (EP) .
0301242 2/1989 (EP) .

* cited by examiner

*Primary Examiner*—J. Reed Batten, Jr.
(74) *Attorney, Agent, or Firm*—Ostrolenk, Faber, Gerb & Soffen, LLP

(57) ABSTRACT

An adjustment device for adjusting the position of at least one strand supporting element (5) relative to a supporting stand (9, 10) carrying at least one further strand supporting element (6), of a strand guide in a continuous casting plant comprises at least one hydraulic adjustment cylinder (12) contacting a strand supporting element (5) directly or indirectly on the one side and the supporting stand (9, 10) carrying a further strand supporting element (6) on the other side, the movement of the strand supporting element (5) being detectable via a position sensor (17) and controllable by means of an automatic controller (26). In order to safely attain the high precision in positioning the strand supporting elements (5, 6) sought for a strand guide at yet a minimum expenditure and a minimum susceptibility to failure, at least one directional control valve (21A, 21B) capable of being switched via a three-level controller (26) is provided for actuating the hydraulic adjustment cylinder (12) FIG. 2.

8 Claims, 4 Drawing Sheets

ADJUSTING DEVICE FOR SETTING THE POSITION OF BILLET-SUPPORT ELEMENTS

Figure 1:
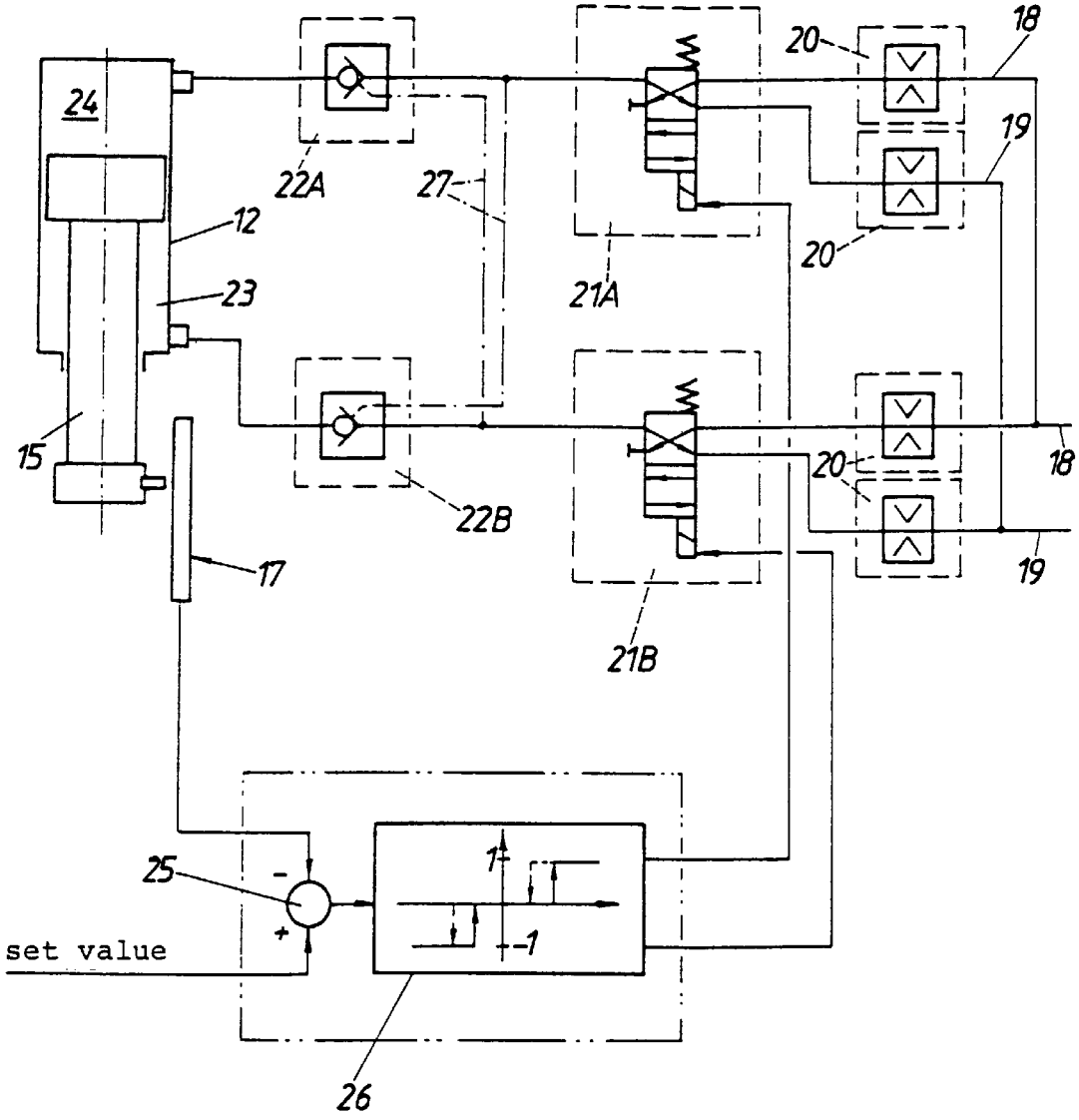

The invention relates to an adjustment device for adjusting the position of at least one strand supporting element, in particular a strand guiding roller, relative to a supporting stand carrying at least one further strand supporting element, of a strand guide in a continuous casting plant and, in particular, a continuous casting plant for steel, comprising at least one hydraulic adjustment cylinder contacting a strand supporting element directly or indirectly on the one side and the supporting stand on the other side, the movement of the strand supporting element being detectable via a position sensor and controllable by means of an automatic controller.

A device of this type is known from U.S. Pat. No. 3,812,900. There, a strand guiding roller arranged on a supporting stand so as to be movable by means of hydraulic adjustment cylinders is moved in the direction towards, or away from, an opposite strand guiding roller rigidly arranged on the supporting stand. The respective position (actual value) of the movable strand guiding roller is determined by means of a measuring device and compared to a set value by means of a comparator. In case of a deviation of the actual value from the set value, the comparator triggers a servo unit via which the hydraulic adjustment cylinders are connectable with the pressure source.

Servo valve technology allows for a very sensitive and rapid control of high outputs at low control inputs due to the assisting effect exerted by the medium flowing through. Servo valve technology in the main is applied in machine tool engineering for delicate positioning tasks. Thus, expenditures both in terms of material and in terms of costs are accordingly high when realizing servo valve technology. Maintenance and measures for avoiding disturbing influences are cumbersome, too.

The application of servo valve technology to continuous casting technology enables the adjustment of the position of the movable strand guiding roller with the utmost precision. Drawbacks are the high material expenditures involved in applying servo valve technology as well as contamination; difficulties may arise in the rough steel works operation.

The invention aims at avoiding these drawbacks and difficulties and has as its object to provide an adjustment device of the initially defined kind, by which the high precision in positioning the strand supporting elements sought for the strand guide can be safely attained, yet only minimum expenditures are required as compared to the prior art, both in terms of production costs and in terms of service and maintenance costs. Influences resulting from casting technology such as dust, high temperatures, splash water derived from strand cooling, etc. are to have no or only minimum effects on the accuracy of strand guide positioning.

In accordance with the invention, this object is achieved in that at least one directional control valve capable of being switched via a three-level controller or a higher-level controller or a controller with a pulse-width output into which the actual value detected by the position sensor may be input via a coupling, is provided for actuating the hydraulic adjustment cylinder.

The provision of a directional control valve renders control engineering substantially easier as compared to the prior art. Although the extremely high accuracy to be attained by servo valve technology is renounced, advantages are nevertheless obtained by substantially lower costs and, moreover, a substantially lower sensitivity to failures such as, e.g., oil contamination or pressure drops or the like. It has been surprisingly shown that directional control valve technology will do for continuous casting even with sensitive steel grades.

By using a controller with a pulse-width output, nearly continuous control as is typically reached with servo or proportional valves may be obtained also with directional control valves. The changing valve opening in those continuously operating valves is replaced with a sequence of pulsed valve openings in the on-off valve. This enables high-accuracy positioning.

Since only small volume flows are required for adjusting a strand supporting element, yet the overall system is operated at high pressures (e.g., 160 bars), a throttle or screen is suitably installed in at least one hydraulic working duct of the hydraulic adjustment cylinder, leading from a pressure fluid supply station to the directional control valve or from the latter to the hydraulic adjustment cylinder.

A preferred embodiment is characterized in that a current control valve with rectification is installed in at least one hydraulic working duct leading from a pressure fluid supply station to the directional control valve or from the latter to the hydraulic adjustment cylinder.

By means of a current control valve, an adjustment speed nearly independent of the load and of the hydraulic pressures corresponding to the same will adjust. A three-level controller or five-level controller configured in conformity with that adjustment speed and the response time and fall time of the respective directional control valve enables the desired set position to be reached very precisely and directly for all cases of load.

A further preferred embodiment is characterized in that a throttle or screen is provided in the hydraulic working duct leading to and/or away from the hydraulic adjustment cylinder, so as to immediately precede respectively follow the hydraulic adjustment cylinder. Thereby, the main throttling effect (or main screening effect) is obtained between the hydraulic adjustment cylinder and the nonreturn valves preceding the same. As a result, the switching times of the nonreturn valves may be kept short and vibrations of the same can be avoided. The arrangement of such throttles or screens in addition to throttles or screens arranged between the pressure source and the directional control valve provides for the facility of largely varying the adjustment speeds of the hydraulic adjustment cylinders, wherein it is to be added that, in principle, the more throttles or screens are provided the larger these throttles or screens may be dimensioned, thus being less sensitive to contamination.

In order to achieve piston adjustment speeds that differ over the adjustment course of the hydraulic adjustment cylinder, and hence attain elevated accuracies, an additional directional control valve is preferably arranged in parallel with a throttle or screen or the current control valve with rectification, wherein suitably a five-level controller or a higher-level controller is provided as a controller.

The invention, furthermore, relates to a strand guide for a continuous casting plant comprising an adjustment device according to the invention. In this case, the position sensor preferably is comprised of a balancing cylinder arranged in parallel with the hydraulic adjustment cylinder and working diametrically opposed to the hydraulic adjustment cylinder and which, on the one side, is connected with a supporting stand carrying a strand supporting element, in particular a supporting segment, and, on the other side, is connected directly or indirectly with a strand supporting element supporting the strand and arranged to be movable relative to the supporting stand.

Figure 5:
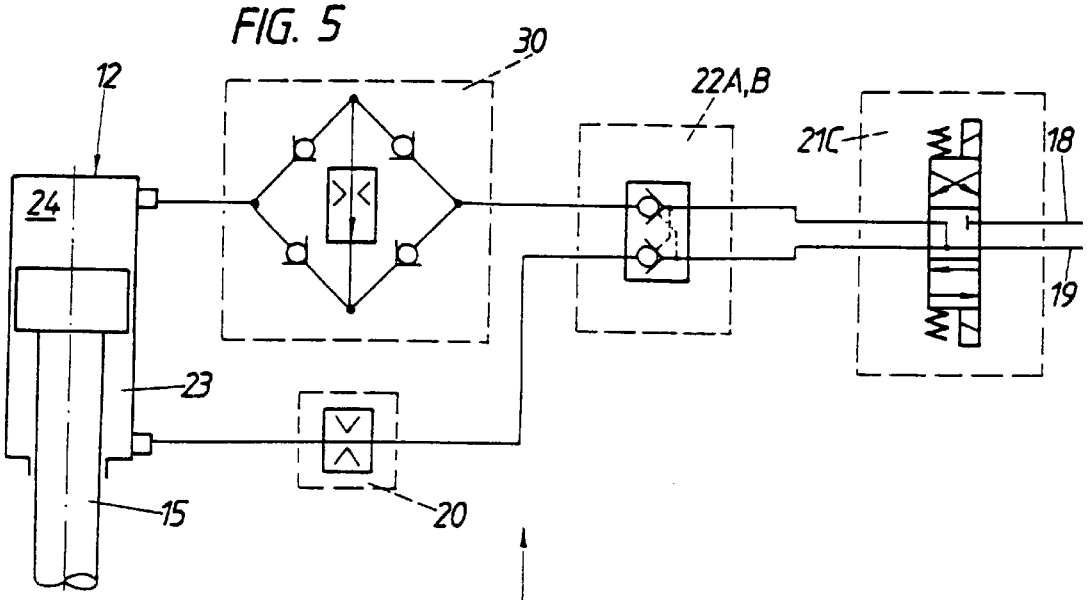
Figure 3:
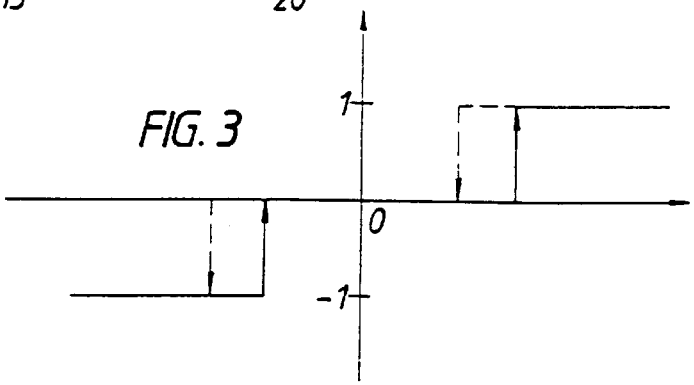
Figure 6:
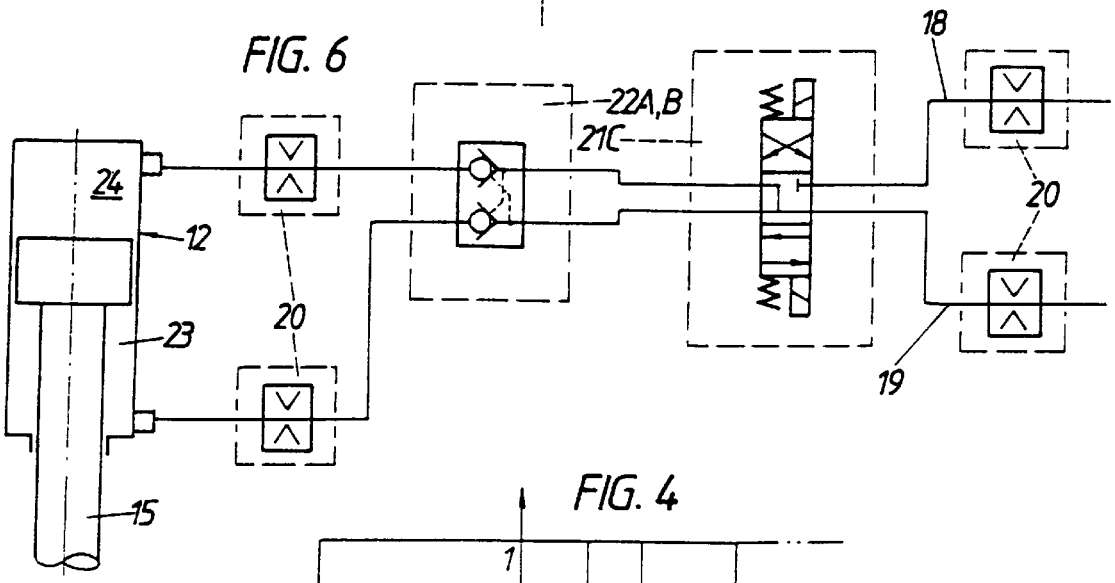
Figure 4:
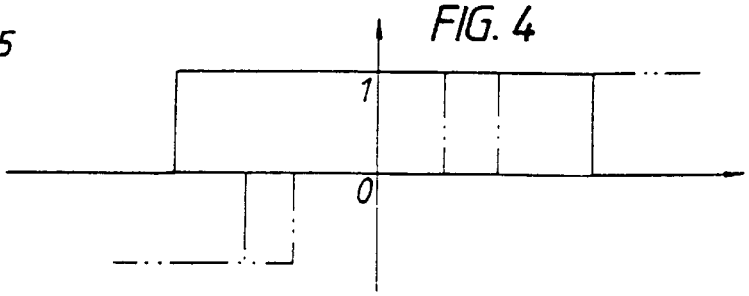
Figure 7:
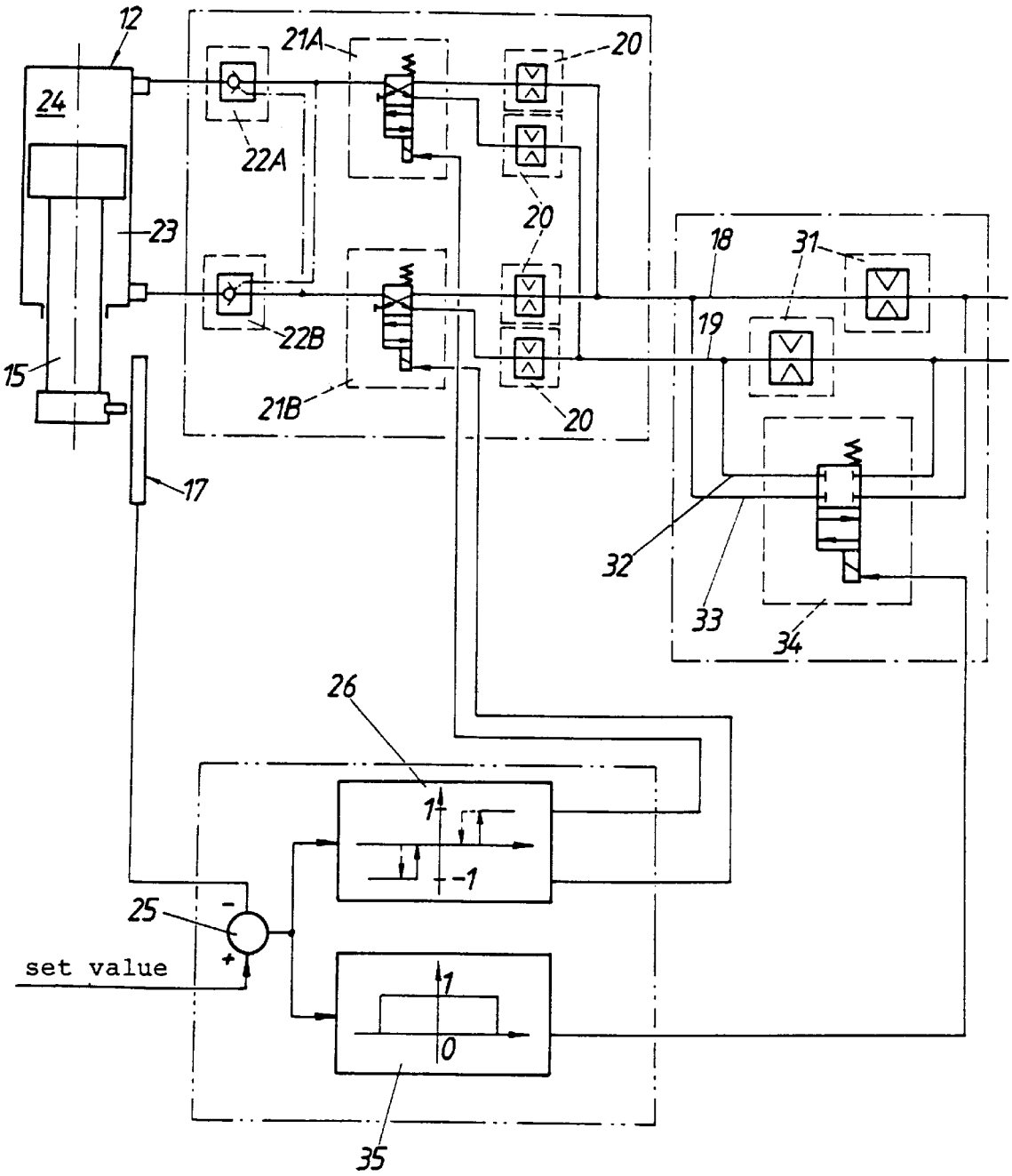

In the following, the invention will be explained in more detail by way of several exemplary embodiments schematically illustrated in the drawing, wherein FIG. 1 depicts an adjustment device according to the invention in a schematic illustration and FIG. 2 its arrangement on a strand guide equipped with strand guiding rollers, also in a schematic illustration. FIGS. 3 and 4 illustrate the modes of operation of a three-level controller and a five-level controller as a function of control deviation. FIG. 5 illustrates a basic circuitry comprising a current control valve, FIG. 6 shows the basic circuitry comprising a 4/3-port directional control valve with screens. FIG. 7 illustrates a valve throttle combination for realizing two adjustment speeds for the piston of a hydraulic adjustement cylinder.

Figure 2:
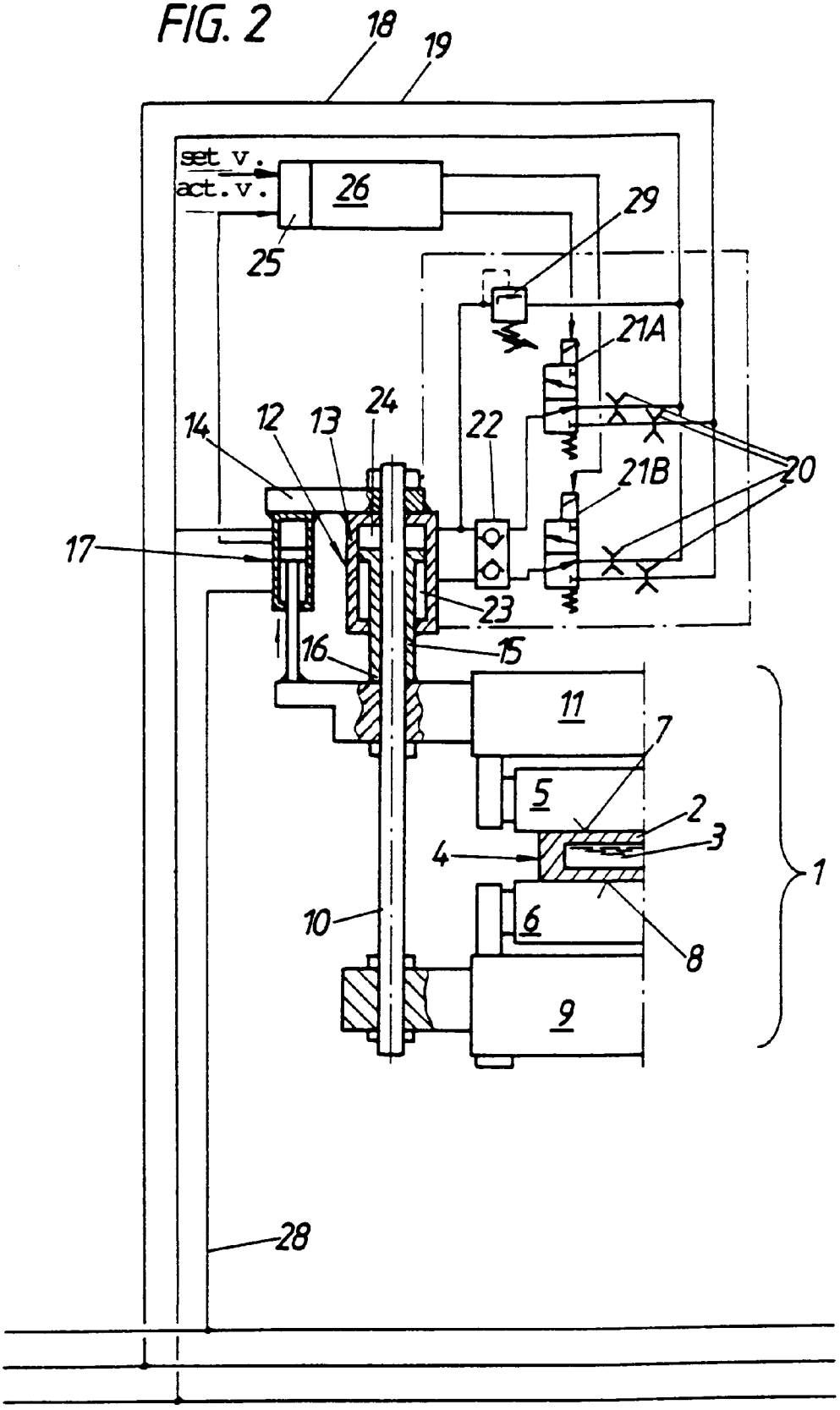

In a strand guide 1, strand guiding rollers 5, 6 as strand supporting elements serve to support the strand 4 having a solidified strand shell 2 and a still liquid core 3, said strand guiding rollers contacting the strand 4 on its wide sides, i.e., according to FIG. 2, on its upper side 7 and lower side 8. As is apparent, in particular, from FIG. 2, the lower strand guiding roller 6 is fastened to a carrier 9 which, by means of tie rods 10 wedged to the carrier 9 of the lower roller 6, is connected with a counter carrier 11 on which the upper strand guiding roller 5 is rotatably journalled. The counter carrier 11 is displaceable along the tie rods 10 such that the distance of the strand guiding rollers 5, 6 can be changed. A hydraulic adjustment cylinder 12 serves to accomplish a movement of the counter carrier 11 relative to the carrier 9. Both the carrier 9 and the counter carrier 11 preferably carry several strand guiding rollers 5 and 6, respectively, forming strand supporting segments.

The cylinder 13 of the hydraulic adjustment cylinder 12 is supported on an additional carrier 14 also wedged relative to the tie rod 10 so as to be fixed in its position relative to the carrier 9. The carrier 9, the tie rod 10 and the additional carrier 14 constitute a supporting stand relative to which the counter carrier 11 is movable. With a view to providing a uniform and radially symmetrial force introduction, the piston 15 of the hydraulic adjustment cylinder 12 preferably is designed as a hollow piston through which the tie rod 10 passes. The front end 16 of the piston 15 is supported on the counter carrier 11.

Between the additional carrier 14 and the counter carrier 11, a balancing cylinder 17 is provided in parallel arrangement with the hydraulic adjustment cylinder 12, which always is actuated in a manner that the counter carrier 11 abuts on the front end of the piston 15 of the hydraulic adjustment cylinder 12, i.e., is pressed against the same. The cylinder of the balancing cylinder 17 is connected with the additional carrier 14 and the piston is connected with the counter carrier 11. This balancing cylinder also could be arranged between the additional carrier 14 and the counter carrier 11 in a position turned by 180°. The balancing cylinder 17 renders feasible the positioning of the counter carrier 11 relative to the carrier 9 without play and, for instance, additionally serves as a position sensor detecting the actual position of the counter carrier 11, as schematically indicated in FIG. 1. In this manner, jams or contaminations of the point of application of force of the hydraulic adjustment cylinder 12 on the counter carrier 11—i.e., on the bearing site of the piston 15—have no adverse effects on the set position of the strand guiding roller 5 to be adjusted.

As is apparent, in particular, from FIG. 1, hydraulic working ducts 18, 19 are each connectable with a respective chamber 23, 24 of the hydraulic adjustment cylinder 12 via throttles 20 or screens and directional control valves 21A, 21B and controlled nonreturn valves 22A, 22B following upon the same. The respective position of the piston 15 of the hydraulic adjustment cylinder 12—and hence of the strand guiding roller 5—is detected via the position sensor, i.e., the balancing cylinder 17, its signal being transmitted to a comparator 25 of a three-level controller 26. The set value adjusted for the position of the piston 15 of the hydraulic adjustment cylinder 12 can be input into the comparator 25. In case of a deviation of the actual value from the set value, the three-level controller 26 enters into function, the valve 21A switching upon the signal +1 and the valve 21B switching upon the signal −1.

The nonreturn valves 22A and 22B provided in the hydraulic working ducts 18, 19 leading to the two chambers 23 and 24 of the hydraulic adjustment cylinder 12, via the control ducts 27, are each actuated by the hydraulic working duct 18, 19 running into the respective other chamber.

According to the embodiment represented in FIG. 2, the balancing cylinder 17 may be fed with pressure from a separate hydraulic working duct 28. In addition, a pressure control valve 29 is provided, which limits the force of the piston 15 of the hydraulic adjustment cylinder 12 as the latter moves the two oppositely arranged strand guiding rollers 5, 6 against each other.

In FIG. 3 controlling of the three-level controller 26 is illustrated in more detail, the selection of the directional control valves being plotted on the ordinate and the control deviation being plotted on the abscissa. If the three-level controller 26 emits the signal +1, the magnet of the directional control valve 21A is switched, whereas the magnet of the directional control valve 21B is idle. If the signal of the three-level controller 26 is 0, both of the magnets of the directional control valves 21A and 21B are idle; with the signal −1 the magnet of the directional control valve 21A is idle and the magnet of the directional control valve 21B is switched.

FIG. 5 depicts a slightly modified circuitry comprising a 4/3-port directional control valve 21C and equipped with a current control valve 30 with rectification. FIG. 6 shows a similar circuitry, likewise with a 4/3-port directional control valve 21C, yet without a current control valve. According to this embodiment, throttles 20 or screens are arranged in the hydraulic working ducts 18, 19 between the nonreturn valves 22A, 22B and the hydraulic adjustment cylinder 12 in addition to throttles 20 or screens provided in front of the 4/3-port directional control valve 21C. This offers the opportunity of widely varying the speeds of the hydraulic adjustment cylinders 12. The throttles or screens may be dimensioned the larger the more throttles or screens are provided, thus offering the advantage of the throttles 20 or screens being substantially less sensitive to contamination.

If, in the embodiment represented in FIG. 6, the throttles 20 or screens provided in front of the 4/3-port directional control valve 21C are omitted, or if these are dimensioned to be larger than the throttles 20 or screens arranged immediately in front of the hydraulic adjustment cylinder 12, the main throttling effect (or main screening effect) may be obtained between the nonreturn valves 22A and 22B and the hydraulic adjustment cylinder 12, thereby enabling the switching times of the nonreturn valves 22A and 22B to be kept particularly short. Besides, vibrations of the nonreturn valves 22A and 22B are avoided by this measure. In principle, the arrangement of throttles 20 or screens may be realized in the immediate vicinity of the hydraulic adjustment cylinder 12, i.e., between the nonreturn valves 22A and 22B and the hydraulic adjustment cylinder 12 also in all of the other embodiments represented in FIGS. 1, 2, 5 and 7 such that the above-described advantages will materialize in those embodiments as well.

FIG. 7 depicts a valve throttle combination for realizing two adjustment speeds for the hydraulic adjustment cylinder 12. The piston 15 of the hydraulic adjustment cylinder 12 may be moved at rapid speed or at creep speed. With this circuitry, in which the part enclosed by dot-and-dash lines is identical with the circuitry according to FIG. 1, additional throttles 31 or screens, which may each be bridged by a bypass 32, 33, precede the directional control valves 21A and 21B in the hydraulic working ducts 18, 19. Bridging may be effected by aid of a directional control valve 34 provided in the bypass ducts 32, 33 and activated or deactivated by means of a five-level controller. Five-level controlling is accomplished by means of a three-level controller 26 according to FIG. 1 whose function corresponds to that of FIG. 3 and a rapid speed/creep speed switch 35 whose function is elucidated in FIG. 4. As the piston 15 of the hydraulic adjustment cylinder 12 approaches the switching zone of the three-level controller 26, a lower speed is switched via the rapid speed/creep speed switch 35 by means of one of the interconnectable screens 31 so as to enable more precise positioning. The rapid speed/creep speed switch 35 by the signal +1 places the directional control valve 34 into the creep speed position illustrated in FIG. 4 and by the signal 0 places the directional control valve 34 into the rapid speed position, in which the hydraulic fluid flows through the bypass ducts 32 and 33.

Instead of the three-level controller 26, a controller with a pulse-width output may be provided.

What is claimed is:

1. An adjustment device for adjusting the position of at least one strand supporting element relative to a supporting stand carrying at least one further strand supporting element, of a strand guide, in a continuous casting plant, comprising at least one hydraulic adjustment cylinder contacting a strand supporting element directly or indirectly on the one side and the supporting stand on the other side, the movement of the strand supporting element being detectable via a position sensor and controllable by means of an automatic controller, characterized in that at least one directional control valve capable of being switched via a three-level controller or at higher-level controller or a controller with a pulse-width output into which the actual value detected by the position sensor is optionally input via a coupling, is provided for actuating the hydraulic adjustment cylinder.

2. An adjustment device according to claim 1, characterized in that a throttle or screen is installed in at least one hydraulic working duct of the hydraulic adjustment cylinder, leading from a pressure fluid supply station to the directional control valve or from the latter to the hydraulic adjustment cylinder.

3. An adjustment device according to claim 1, characterized in that a current control valve with rectification is installed in at least one hydraulic working duct leading from a pressure fluid supply station to the directional control valve or from the latter to the hydraulic adjustment cylinder.

4. An adjustment device according to claim 1, characterized in that a throttle or screen is provided in the hydraulic working duct leading to and/or away from the hydraulic adjustment cylinder, so as to immediately precede respectively follow the hydraulic adjustment cylinder.

5. An adjustment device according to claim 1, characterized in that an additional directional control valve is arranged in parallel with a throttle or screen or the current control valve with rectification.

6. An adjustment device according to claim 5, characterized in that a five-level controller or a higher-level controller is provided as a controller.

7. A strand guide for a continuous casting plant, comprising a stand, a roller in fixed position relative to the stand, a roller in displaceable position along the stand and means for controlling the movement of the displaceable roller, said means comprising an automatic adjustment device according to claim 1.

8. A strand guide according to claim 7, characterized in that the position sensor is comprised of a balancing cylinder arranged in parallel with the hydraulic adjustment cylinder and working diametrically opposed to the hydraulic adjustment cylinder and which, on the one side, is connected with a supporting stand carrying a strand supporting element, and, on the other side, is connected directly or indirectly with a strand supporting element supporting the strand and arranged to be movable relative to the supporting stand.

* * * * *